US006682415B1

(12) United States Patent
Vagedes

(10) Patent No.: US 6,682,415 B1
(45) Date of Patent: Jan. 27, 2004

(54) QUICK CONNECT DRYER VENT

(75) Inventor: Michael Vagedes, Erlanger, KY (US)

(73) Assignee: Bluegrass Products, L.L.C., Erlanger, KY (US)

( * ) Notice: Subject to any disclaimer, the term of this patent is extended or adjusted under 35 U.S.C. 154(b) by 0 days.

(21) Appl. No.: 10/414,114

(22) Filed: Apr. 15, 2003

(51) Int. Cl.[7] ..... F24F 13/02
(52) U.S. Cl. ..... 454/339; 454/353; 34/235
(58) Field of Search ..... 454/339, 353; 34/235, 175; 285/223, 235, 236

(56) References Cited

U.S. PATENT DOCUMENTS

| | | | | |
|---|---|---|---|---|
| 4,214,380 | A | 7/1980 | Meyer | 34/235 |
| 4,967,490 | A | 11/1990 | Berger et al. | 34/235 |
| 5,568,947 | A | 10/1996 | Paquette | 285/46 |
| 5,584,129 | A | 12/1996 | Williamson | 34/235 |
| 5,722,181 | A | 3/1998 | Meyer | 34/235 |
| 5,916,023 | A | 6/1999 | Meyer | 454/359 |
| 5,970,623 | A | 10/1999 | Tuggle | 34/134 |
| 6,302,788 | B1 | 10/2001 | Gagnon | 454/367 |
| 6,443,834 | B1 | 9/2002 | Berger | 454/353 |
| 6,463,673 | B1 * | 10/2002 | Gherna | 34/235 |

OTHER PUBLICATIONS

2001/0000834, *Dryer Vent Connection and Method*, Irey USSN 09/746,319, Filed Dec. 22, 2000, Published May 10, 2001.

2002/0149201, *Apparatus for Coupling Dryer to Vent Ducting and Method of Use*, Pichotta, USSN 10/162,013, Filed Jun. 4, 2002, Published Oct. 17, 2002.

* cited by examiner

*Primary Examiner*—Jiping Lu
(74) *Attorney, Agent, or Firm*—Wood, Herron & Evans, L.L.P.

(57) ABSTRACT

A replacement dryer vent for remodelers includes a typical exterior vent portion and an interior tube portion. The tube portion extends into the building and has an internal diameter that increases towards its innermost edge, i.e., toward the interior of the building. The extension is designed to slip over an existing cylindrical duct already in a wall. This allows one to replace an existing dryer vent by simply removing the exterior vent portion and leaving the duct work in position. The new vent is simply inserted in the existing hole with the tube slipping over the duct making a tight connection.

6 Claims, 2 Drawing Sheets

QUICK CONNECT DRYER VENT

BACKGROUND

Dryer vents typically include an external hood or louvered vent which attaches to a metal tube which extends through a building wall. This in turn is attached to the dryer via a flexible duct or sheet metal duct.

When houses are remodeled, it is typical to replace these dryer vents particularly if vinyl siding is being applied to the exterior of the building. In such situations the old dryer vent must be replaced and a complete new dryer vent installed with a new metal tube extending back through the wall. This is relatively time consuming in that it requires the individual to disconnect the dryer, move it out of the way and the install the new dryer vent. It would be preferable, however, to simply replace the exterior hood or louvered vent without replacing the internal metal tubing. This, however, is impossible with current structures because the metal tube is typically attached to the hood or louvered vent by a small channel that extends either only to the exterior surface of the building or slightly inwardly approximately an inch.

SUMMARY OF THE INVENTION

Accordingly it is an object of the present invention to provide a dryer vent wherein the dryer vent can be replaced without replacing the metal duct which extends through the house. More particularly, the present invention is an external vent adapted to be attached to the exterior of a building. The vent includes an inwardly extended tube portion. The tube portion extends inwardly approximately two to three inches and its interior most surface has an interior diameter that increases as it extends away from the vent. In other words, the internal diameter of the interior side edge is wider than the internal diameter of the tube at its extension side. This allows the existing duct to simply slide within the tube to provide an adequate connection between the dryer vent and the duct.

The objects and advantages of the present invention will be further appreciated in light of the following detailed descriptions and drawings in which:

DETAILED DESCRIPTION

Figure 1:
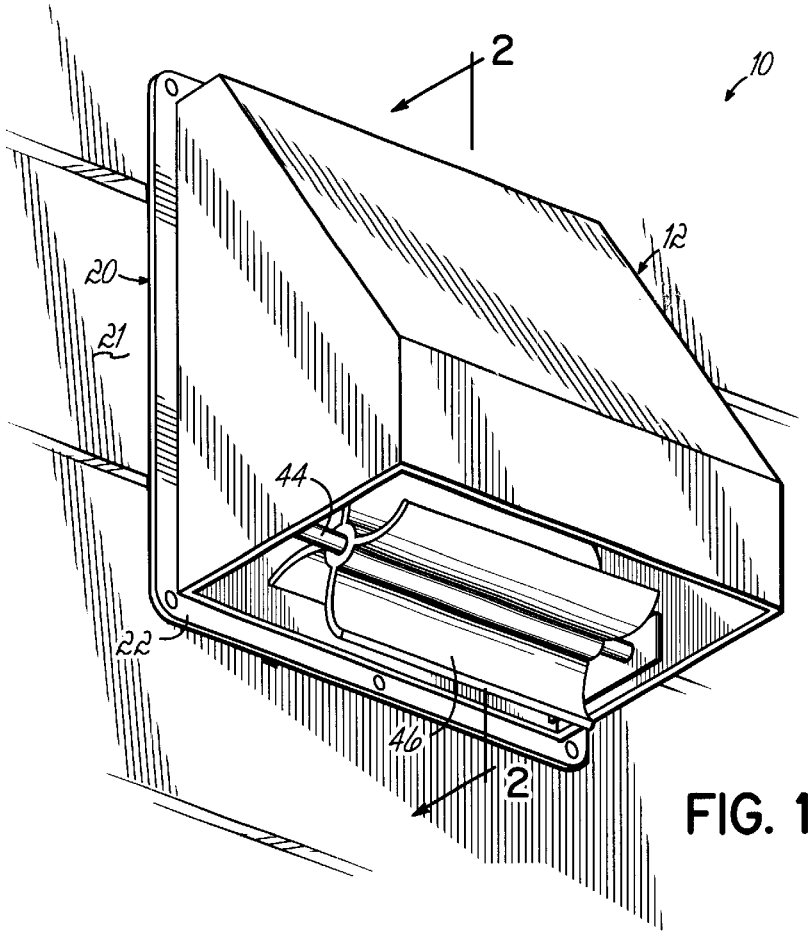
FIG. 1 is a perspective view of the present invention.

The present invention is a dryer vent 10 shown with a hood portion 12, a rearwardly extended tubular extension or tube member 16 which extends from circular opening 18. The hood 12 is designed to face away from the exterior of the building with the tube 16 extending into the building. Between the hood portion 12 and the tube 16 is a plate 20 having a nailing flange 22 which attaches to the side of the building and defines opening 18.

The embodiment shown in FIG. 1 is exemplary. This uses a hooded vent portion. The present invention can also be used with a typical flat louvered vent, metal grading or the like, basically any structure used for a dryer vent. It can also include a siding reveal (i.e., J-channel) if desired. These exterior portions such as hood 12 are designed to prevent rain from entering the building through the vent. Also, they are designed to prevent cold air from entering through the vent. The particular embodiment shown in FIGS. 1 and 2 also incorporates a paddlewheel 46 which rotates on axle 44 which extends between tabs 38 and 40. These are more particularly described in pending application Ser. No. 10/277,034 filed Oct. 21, 2002 entitled DRYER VENT, the disclosure of which is incorporated herein by reference.

Figure 2:
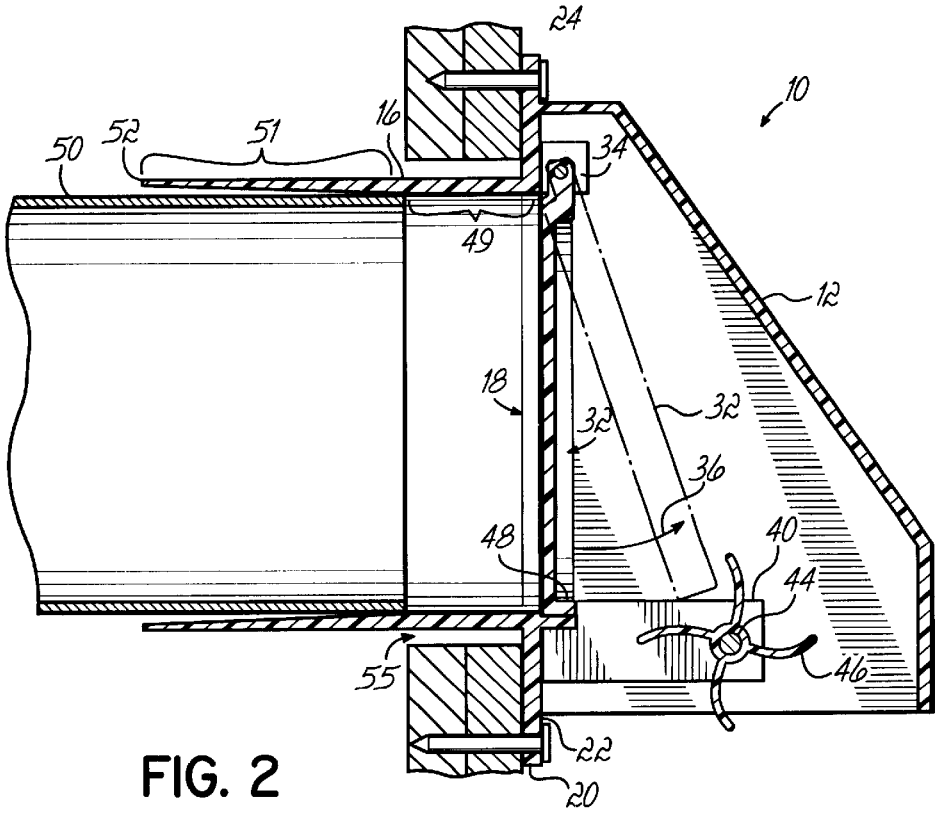
FIG. 2 is a cross-sectional view taken at lines 2—2 of FIG. 1.
Figure 3:
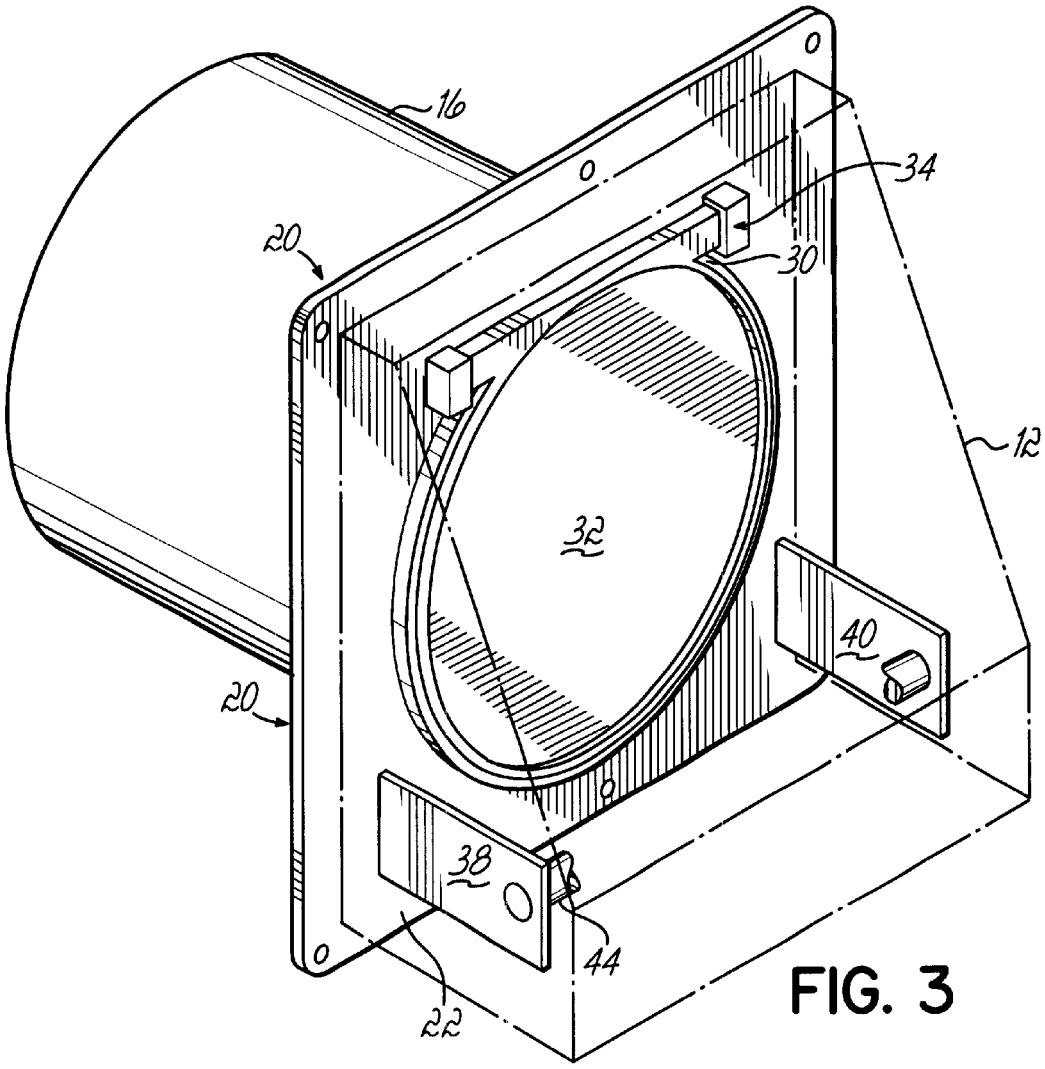
FIG. 3 is a perspective view of the present invention partially in phantom and partially broken away.

Further the embodiment shown in FIGS. 1–3 incorporate a circular flap 32 which is pivotally attached to plate 20 at tab 34 allowing it to rotate open in the direction of arrow 36 in response to air pressure. This simply is an added feature to prevent birds and rodents from entering through the opening.

As shown more particularly in FIG. 2, tube member 16 is designed to extend two to three inches or more inwardly beyond the plane of plate 20. The first portion 49 of tube 16, i.e., the first three-quarters of an inch has a diameter approximately equal to the external diameter of duct 50, generally about four inches in diameter. As one extends rearwardly in the direction away from plate 20, the internal diameter of tube 16 expands so that at its innermost edge 52, its innermost surface has a diameter which is greater than the external diameter of tube 50, generally approximately 0.2 inches or more in diameter greater than the exterior diameter of tube 50. In a preferred embodiment, the tube 16 is about two inches and preferably three inches in length and has an internal tapered portion 51 which is approximately 2.75 inches in length so that the internal diameter increases from 4.0 inches to 4.2 inches over 2.75 inches culminating in the maximum diameter at edge 52. This allows the tube 16 to slide easily over duct 50 providing a quick generally air-tight fit.

In use, the vent 10 of the present invention would be installed by first removing an existing vent from the side of a building leaving a duct 50 in place in an opening 55. Siding 21 would be applied to the building if necessary and the replacement vent 10 of the present invention would be inserted through the hole 55 in the building with tube 16 fitting around the duct 50. The vent 10 would then be nailed or secured to the walls as shown by nails 24 which extend through exterior flange 22 of plate 20 holding it in position.

This enables one to remove an existing vent, replace it with the vent of the present invention without disconnecting duct 50 from the dryer. This allows the entire work to be done from the exterior of the house so that the worker does not need to go into the interior. This significantly reduces the time necessary to replace the dryer vent in turn saving a significant amount of time.

This has been a description of the present invention along with the preferred method of practicing the invention, however, the invention itself should only be defined by the appended claims wherein

I claim:

1. A dryer vent having a vent portion adapted to attached to the exterior side of the building along a surface said vent including:

a tube extending from said surface inwardly away from said vent portion;

said tube having a cylindrical cross-section and an internal diameter said internal diameter increasing from a point near said surface to an innermost edge of said tube and said tube having a length adapted to extend into a building wall and engage a tubular duct within said wall.

2. The vent claimed in claim 1 wherein said tube has a length of at least two inches.

3. The vent claimed in claim 1 wherein said tube has a length of at least three inches.

4. The vent claimed in claim 1 wherein said internal diameter of said tube increases at least about 0.2 inches.

5. The vent claimed in claim 2 wherein said diameter of said tube increases at least about 0.2 inches.

6. The vent claimed in claim 5 wherein said tube has an inner tapered portion extending at least about one inch.

* * * * *